US009071904B2

(12) United States Patent
Christoph

(10) Patent No.: US 9,071,904 B2
(45) Date of Patent: Jun. 30, 2015

(54) NOISE REDUCING SOUND-REPRODUCTION

(75) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 454 days.

(21) Appl. No.: 13/559,299

(22) Filed: Jul. 26, 2012

(65) Prior Publication Data

US 2013/0028435 A1 Jan. 31, 2013

(30) Foreign Application Priority Data

Jul. 26, 2011 (EP) ..... 11 175 343

(51) Int. Cl.

| | |
|---|---|
| ***H04R 3/00*** | (2006.01) |
| ***G10K 11/16*** | (2006.01) |
| ***H04R 1/10*** | (2006.01) |
| ***G10K 11/178*** | (2006.01) |

(52) U.S. Cl.

CPC ..... *H04R 1/1083* (2013.01); *G10K 11/178* (2013.01); *H04R 1/1008* (2013.01); *H04R 3/005* (2013.01); *G10K 2210/1081* (2013.01); *H04R 2420/01* (2013.01)

(58) Field of Classification Search

CPC ..... H04R 25/453; H04R 25/456; H04R 2460/01; H04R 2420/07; H04R 1/1083; H04R 5/033; H04R 2225/43; H04R 1/1008; G10K 11/178; G10K 11/1788; G10K 11/1081; G10K 2210/1081; A61F 11/08; A61F 2011/085

USPC ..... 381/71.6, 71.1, 71.7, 71.8, 94.1, 381/370–375, 382, 74

See application file for complete search history.

(56) References Cited

U.S. PATENT DOCUMENTS

| | | | | |
|---|---|---|---|---|
| 4,953,217 | A | 8/1990 | Twiney et al. | |
| 2008/0159554 | A1* | 7/2008 | Sung et al. | 381/71.6 |
| 2009/0080670 | A1* | 3/2009 | Solbeck et al. | 381/71.6 |
| 2009/0190771 | A1 | 7/2009 | Sung | |
| 2010/0014685 | A1 | 1/2010 | Wurm | |
| 2010/0080400 | A1 | 4/2010 | Sibbald et al. | |

(Continued)

OTHER PUBLICATIONS

Antila et al., "Microcontroller-Driven Analogue Filter for Active Noise Control", Hardware for Active Control, ISVR, Southampton, UK, Jul. 2002, pp. 449-456.

(Continued)

*Primary Examiner* — Vivian Chin
*Assistant Examiner* — David Ton
(74) *Attorney, Agent, or Firm* — O'Shea Getz P.C.

(57) ABSTRACT

An active noise reduction system includes an earphone with a cup-like housing and a transmitting transducer, which converts electrical signals into acoustical signals and is arranged at an aperture of the housing. A receiving transducer converts acoustical signals into electrical signals, and is arranged proximate the transmitting transducer. A duct includes an end acoustically coupled to the receiving transducer, and another end located proximate the transmitting transducer. An acoustical path extends from the transmitting transducer to a listener's ear, and has a first transfer characteristic. Another acoustical path extends from the transmitting transducer through the duct to the receiving transducer, and which has a second transfer characteristic. A control unit generates a noise reducing electrical signal that is supplied to the transmitting transducer. This signal is derived from the receiving-transducer signal and filtered with a third transfer characteristic. The second and third transfer characteristics together model the first transfer characteristic.

14 Claims, 5 Drawing Sheets

(56) References Cited

U.S. PATENT DOCUMENTS

| | | | | |
|---|---|---|---|---|
| 2010/0208909 | A1* | 8/2010 | Sung et al. | 381/71.6 |
| 2012/0314882 | A1* | 12/2012 | Sibbald | 381/71.6 |

OTHER PUBLICATIONS

Kataja et al., "An Opitimisation-Based Design Method for Analogue Feedback Controllers for Active Noise Control", Feedback Control, ISVR, Southampton, UK, Jul. 2002, pp. 1203-1210.

Kuo, "Active Noise Control System for Headphone Applications" IEEE Transactions on Control Systems Technology, vol. 14, No. 2, Mar. 2006, pp. 331-335.

Hansen et al., "Active Control of Noise and Vibration", E & FN Spon, and Imprint of Chapman & Hall, 1997.

Kuo et al., "Active Noise Control: A Tutorial Review", Proceedings of the IEEE, vol. 87, No. 6, Jun. 1999, pp. 943-973.

Nelson et al., "Active Control of Sound", Academic Press 1992, United States Edition published by Academic Press Inc., San Diego, CA 92101, ISBN: 0-12-515425-9.

* cited by examiner

NOISE REDUCING SOUND-REPRODUCTION

CLAIM OF PRIORITY

This patent application claims priority from EP Application No. 11 175 343.0 filed Jul. 26, 2011, which is hereby incorporated by reference.

FIELD OF TECHNOLOGY

The present invention relates to active audio noise reduction, and in particular to a noise reducing sound reproduction system which includes an earphone for allowing a listener to enjoy, for example, reproduced music or the like, with reduced ambient noise.

RELATED ART

In active noise reduction (or cancellation or control) systems that employ headphones with one or two earphones, a microphone has to be positioned somewhere between a loudspeaker arranged in the earphone and the listener's ear. However, such arrangement is uncomfortable for the listener and may lead to serious damage to the microphones due to reduced mechanical protection of the microphones in such positions. Microphone positions that are more convenient for the listener or more protective of the microphones or both are often insufficient from an acoustic perspective, thus requiring advanced electrical signal processing to compensate for the acoustic drawbacks. Therefore, there is a general need for an improved noise reduction system employing a headphone.

SUMMARY OF THE INVENTION

An active noise reduction system includes an earphone to be acoustically coupled to a listener's ear when exposed to noise. The earphone comprises a cup-like housing with an aperture; a transmitting transducer which converts electrical signals into acoustical signals to be radiated to the listener's ear and which is arranged at the aperture of the cup-like housing, thereby defining an earphone cavity located behind the transmitting transducer; a receiving transducer which converts acoustical signals into electrical signals and which is arranged behind, alongside or in front of the transmitting transducer; a sound-guiding duct having first and second ends; the first end is acoustically coupled to the receiving transducer and the second end is located behind, alongside or in front of the transmitting transducer; a first acoustical path extends from the transmitting transducer to the ear and which has a first transfer characteristic; a second acoustical path extends from the transmitting transducer through the duct to the receiving transducer and which has a second transfer characteristic; a control unit is electrically connected to the receiving transducer and the transmitting transducer and generating a noise reducing electrical signal that is supplied to the transmitting transducer to compensate for the ambient noise. The noise reducing electrical signal is derived from the receiving-transducer signal, filtered with a third transfer characteristic, and in which the second and third transfer characteristics together model the first transfer characteristic.

These and other objects, features and advantages of the present invention will become apparent in the detailed description of the best mode embodiment thereof, as illustrated in the accompanying drawings. In the figures, like reference numerals designate corresponding parts.

DESCRIPTION OF THE DRAWINGS

Various embodiments are described in more detail below based on the exemplary embodiments shown in the figures of the drawing. Unless stated otherwise, similar or identical components are labeled in all of the figures with the same reference numbers.

DETAILED DESCRIPTION OF THE INVENTION

Figure 1:
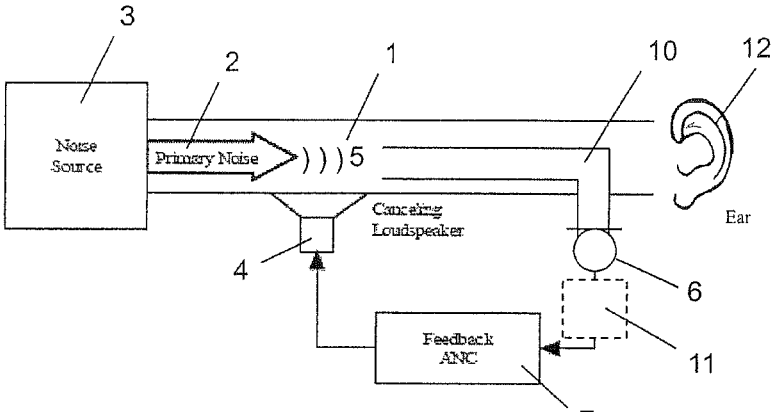
FIG. 1 is a block diagram illustration of a general feedback active noise reduction system.

FIG. 1 is a simplified illustration of an active noise reduction system of the feedback type having an earphone. An acoustic channel represented by a tube 1, is established by the ear canal, also known as external auditory meatus, and parts of the earphone, into which noise, i.e., primary noise 2, is introduced at a first end from a noise source 3. The sound waves of the primary noise 2 travel through the tube 1 to the second end of the tube 1 from where the sound waves are radiated, e.g., to the tympanic membrane of a listener's ear 12 when the earphone is attached to the listener's head. In order to reduce or cancel the primary noise 2 in the tube 1, a sound radiating transducer, e.g., a loudspeaker 4, introduces cancelling sound 5 into the tube 1. The cancelling sound 5 has an amplitude corresponding to, e.g., being the same as the external noise, however of opposite phase. The external noise 2 which enters the tube 1 is collected by an error microphone 6 and is inverted in phase by a feedback active noise controlling (ANC) processing unit 7 and then emitted from the loudspeaker 4 to reduce the primary noise 2. The error microphone 6 is arranged downstream of the loudspeaker 4 and thus is closer to the second end of the tube 1 than to the loudspeaker 4, i.e., it is closer to the listener's ear 12, in particular to the tympanic membrane.

Figure 2:
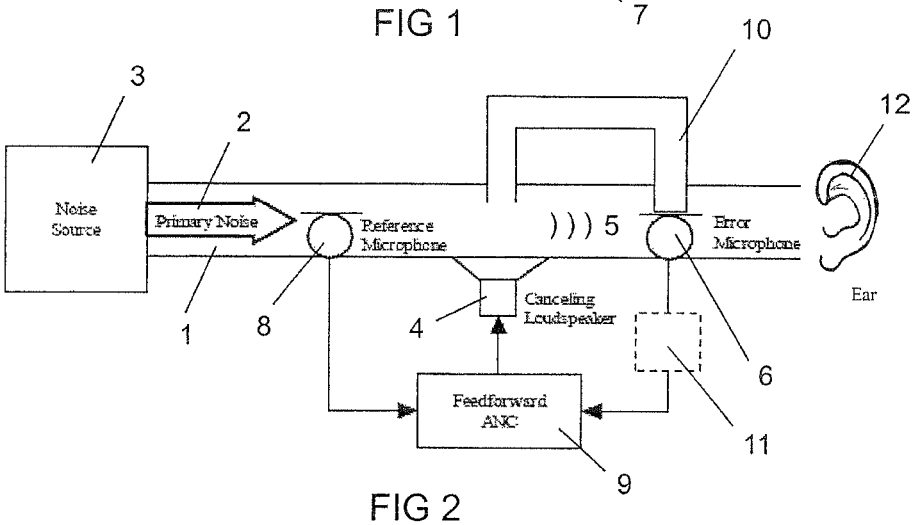
FIG. 2 is a block diagram illustration of a general feedforward noise reduction system.

An active noise reduction system of the feedforward type is shown in FIG. 2 that includes an additional reference microphone 8 provided between the noise source 3 and the loudspeaker 4, and a feedforward ANC processing unit 9 that replaces the feedback ANC processing unit 7 of FIG. 1. The reference microphone 8 senses the primary noise 2 and its output is used to adapt the transmission characteristic of a path from the loudspeaker 4 to the error microphone 6, such that it matches the transmission characteristic of a path along which the primary noise 2 reaches the second end of the tube 1. The primary noise 2 (and sound radiated from the loudspeaker 4) is sensed by the error microphone 6 and is inverted in phase using the adapted (e.g., estimated) transmission characteristic of the signal path from the loudspeaker 4 to the error microphone 6 and is then emitted from the loudspeaker 4 arranged between the two microphones 6, 8, thereby reducing the undesirable noise at the listening location. Signal inversion as well as transmission path adaptation are performed by the feedforward ANC processing unit 9.

Figure 3:
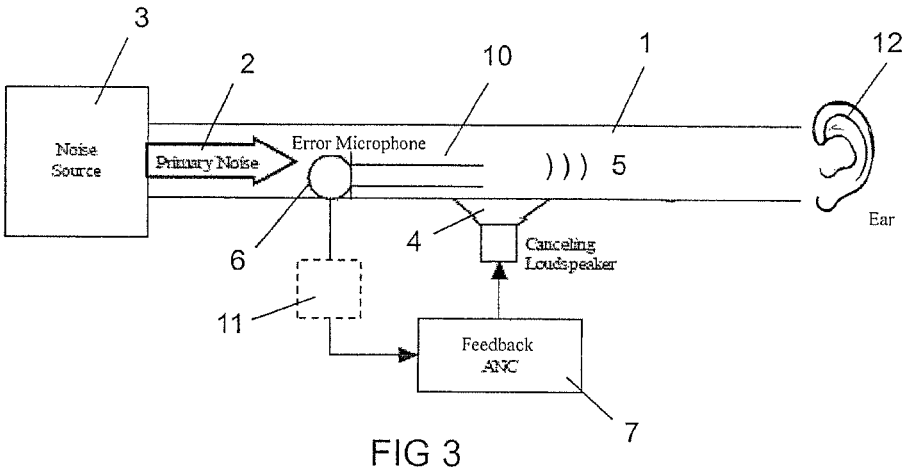
FIG. 3 is a block diagram illustration of an embodiment of a feedback active noise reduction system disclosed herein.

Another example of a feedback active noise reduction system is shown in FIG. 3. The system of FIG. 3 differs from the system of FIG. 1 in that the error microphone 6 is arranged between the first end of the tube 1 and the loudspeaker 4, instead of being arranged between the loudspeaker 4 and the second end of the tube 1.

In the systems shown in FIGS. 1, 2 and 3, the error microphone 6 is equipped with a sound-guiding conduit (e.g., a tube) 10 having two ends. One end of the conduit 10 is acoustically coupled to the receiving transducer, in the present case the error microphone 6, and the other may be located in the tube 1 alongside or in front of (or even behind) the transmitting transducer, i.e., the loudspeaker 4. The second end may be arranged close to the front of the loudspeaker 4 or at any other appropriate position. The duct 10 guides the sound from its second end to its first end and, accordingly, to the error microphone 6, thereby providing acoustic filtering of the sound travelling through the duct 10. Furthermore, an electrical filter 11 (e.g., non-adaptive), i.e., a filter with a constant transfer characteristic, may be connected downstream of the error microphone 6, as indicated in FIGS. 1-3, by a dotted block. The filter 11 (e.g., an analog low-pass filter) may be provided to compensate for some deficiencies of the duct 10 and is, due to its non-adapting behavior, less complex than an adaptive filter.

The duct 10 provides per se or in connection with the filter 11 a certain transfer characteristic which models at least partially the signal path from the loudspeaker 4 to the listener's ear 12. Thus, less adaption work has to be done by the processing units 7 and 9, to the effect that these units can be implemented with less cost. Moreover, the modeling of the path between the loudspeaker 4 and the listener's ear 12 by the duct 10 is rather simple, as both have tube-like structures. The ANC units 7 and 9 can be less complex than usual, as they are only intended to compensate for fluctuations in the system caused by fluctuations in ambient conditions such as change of listeners, temperature, ambient noise, or repositioning of the earphone. The transfer function of the duct (together with the transfer characteristic of the filter 11) may be configured to match an average first transfer function derived from a multiplicity of different listeners.

Figure 4:
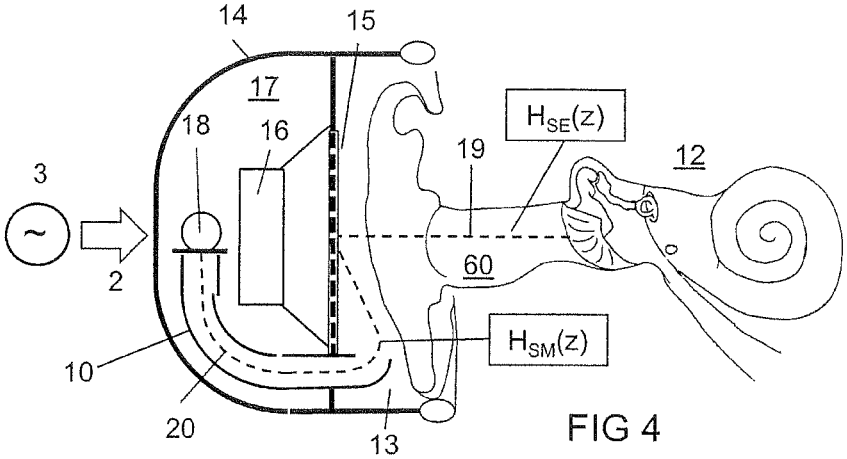
FIG. 4 is a schematic illustration of an earphone employed in an embodiment of an active noise reduction system, in which the microphone is arranged behind the loudspeaker.

FIG. 4 is an illustration of an earphone employed in an active noise reduction system. The earphone may be, together with another identical earphone, part of a headphone (not shown) and may be acoustically coupled to a listener's ear 12. In the present example, the ear 12 is exposed to the primary noise 2, e.g., ambient noise, originating from a noise source 3. The earphone comprises a cup-like housing 14 with an aperture 15. The aperture 15 may be covered by a sound permeable cover, e.g., a grill, a grid or any other sound permeable structure or material.

A transmitting transducer that converts electrical signals into acoustical signals to be radiated to the ear 12, and that is formed by a loudspeaker 16 in the present example, is arranged at the aperture 15 of the housing 14, thereby forming an earphone cavity 17. The loudspeaker 16 may be hermetically mounted to the housing 14 to provide an air tight cavity 17, i.e., to create a hermetically sealed volume. Alternatively, the cavity 17 may be vented by, e.g., port, vent, opening, etc.

A receiving transducer that converts acoustical signals into electrical signals, e.g., an error microphone 18 is arranged within the earphone cavity 17. The error microphone 18 is arranged between the loudspeaker 16 and the noise source 3. An acoustical path 19 extends from the speaker 16 to the ear 12 (and its external auditory meatus 60) and has a transfer characteristic of $H_{SE}(z)$. An acoustical path 20 extends from the loudspeaker 16 through the duct 10 to the error microphone 18 and has a transfer characteristic of $H_{SM}(z)$. The duct 10 is in this example comprises a bended tube of certain diameter and length that extends from the rear of the loudspeaker 16 through the front portion of the housing 14 to a cavity 13 between the front portion of the housing 14 and the outer portion of the ear 12. Diameter and length of the tube forming the duct 10 are such that the transfer characteristic $H_{SM}(z)$ of the acoustical path 20 is approximately equal to the transfer characteristic $H_{SE}(z)$ of the acoustical path 19 or approximates the transfer characteristic $H_{SE}(z)$ at least partially.

Figure 5:
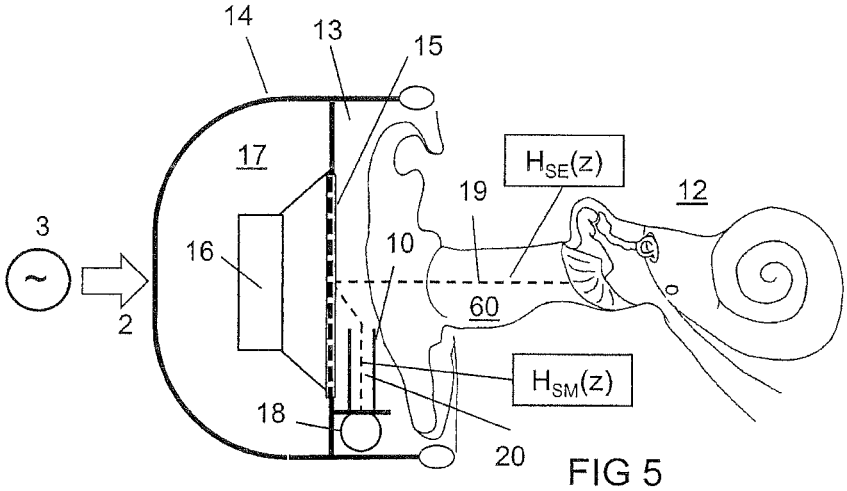
FIG. 5 is a schematic illustration of an alternative earphone in which the microphone is arranged in front of the loudspeaker.

FIG. 5 illustrates the earphone 11 of FIG. 4, however, with the microphone 18 positioned at the front outer edge of the loudspeaker 16. The duct 10 is formed by an elongated tube and has two ends, one of which is acoustically coupled to the (e.g., front of the) microphone 18 and the other is located around the front center of the loudspeaker 16. Diameter and length of the tube are again such that the transfer characteristic $H_{SM}(z)$ of the acoustical path 20 is approximately equal to the transfer characteristic $H_{SE}(z)$ of the acoustical path 19 or approximates the transfer characteristic $H_{SE}(z)$ at least partially.

Figure 6:
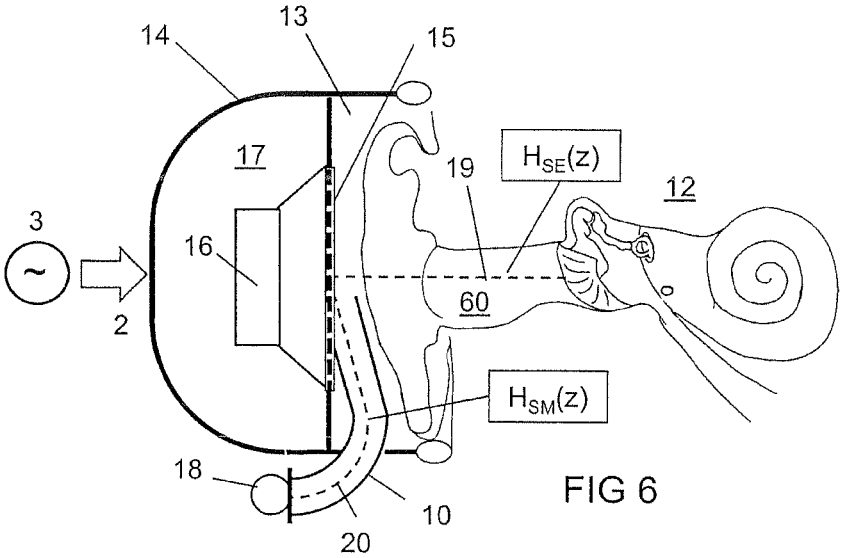
FIG. 6 is a schematic illustration of another alternative earphone in which the microphone is arranged alongside the loudspeaker.

FIG. 6 is an illustration of the earphone shown in FIG. 4, however, with the microphone 18 positioned alongside the loudspeaker 16. The duct 10 is formed by an elongated tube and has two ends, one of which is connected to the (front of the) microphone 18 and the other is located near the front center of the loudspeaker 16. Diameter and length of the tube are again such that the transfer characteristic $H_{SM}(z)$ of the acoustical path 20 is approximately equal to the transfer characteristic $H_{SE}(z)$ of the acoustical path 19 or approximates the transfer characteristic $H_{SE}(z)$ at least partially.

Figure 7:
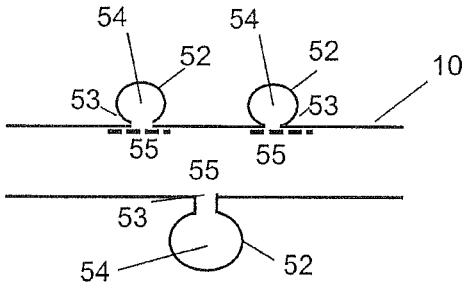
FIG. 7 is a schematic illustration of a duct employed in an embodiment of an active noise reduction system that includes Helmholtz resonators.

The tube-like duct 10 may be configured and arranged to further influence the acoustic behavior of the duct 10 as illustrated below with reference to FIGS. 7-11. Referring to FIG. 7, the duct 10 may include Helmholtz resonators. A Helmholtz resonator typically includes an air mass enclosing cavity, a chamber, and a venting opening or tube, e.g., a port or neck that connects the air mass to the outside.

Helmholtz resonance is the phenomenon of air resonance in a cavity. When air is forced into a cavity the pressure inside increases. When the external force pushing the air into the cavity is removed, the higher-pressure air inside will flow out. However, this surge of air flowing out will tend to overcompensate the air pressure difference, due to the inertia of the air in the neck, and the cavity will be left with a pressure slightly lower than the outside, causing air to be drawn back in. This process repeats itself with the magnitude of the pressure changes decreasing each time. The air in the port or neck has mass. Since it is in motion, it possesses some momentum.

A longer port would make for a larger mass. The diameter of the port also determines the mass of air and the volume of air in the chamber. A port that is too small in area for the chamber volume will "choke" the flow while one that is too large in area for the chamber volume tends to reduce the momentum of the air in the port. In the present example, three resonators 52 are employed, each having a neck 53 and a chamber 54. The duct includes openings 55 where the necks 53 are attached to the duct 10 to allow the air to flow from the inside of the duct 10 into the chamber 54 and out again.

Figure 8:
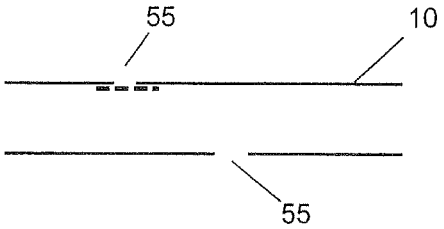
FIG. 8 is a schematic illustration of another duct having openings.
Figure 9:
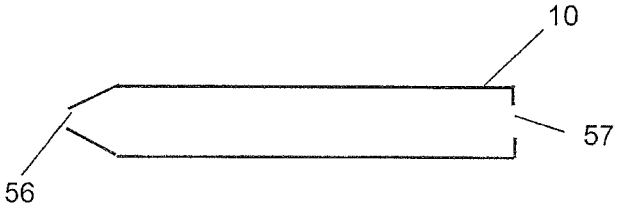
FIG. 9 is a schematic illustration of another duct having semi-closed ends.
Figure 10:
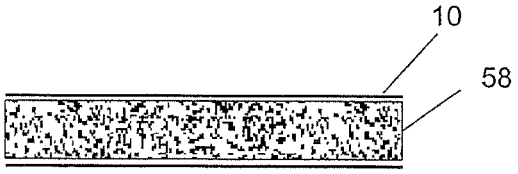
FIG. 10 is a schematic illustration of another duct filled with sound-absorbing material.
Figure 11:
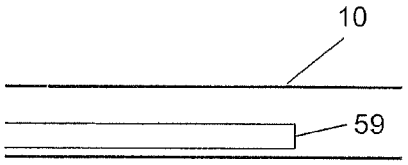
FIG. 11 is a schematic illustration of another duct such as a tube having a tube-in-tube structure.

The duct 10 shown in FIG. 8 has the openings 55 only, i.e., without the resonators 52 and the necks 53. The openings 55 in the ducts 10 shown in FIGS. 7 and 8 may be covered by a sound-permeable membrane (indicated by a broken line) to allow further sound tuning. The alternative embodiment illustrated with reference to FIG. 9 has cross-section reducing tapers 56, 57 at both its ends (or anywhere in between). In the embodiment shown in FIG. 10, the duct 10 is filled with sound absorbing material 58 such as for example, rock wool, sponge, foam etc. According to FIG. 11, a tube-in-tube structure may be employed with another tube 59 arranged in the duct 10, whereby the tube 59 is closed at one end and has diameter and length which are smaller than the diameter and length of the tube forming duct 10. The tube 59 forms a Helmholtz resonator within the duct 10.

Figure 12:
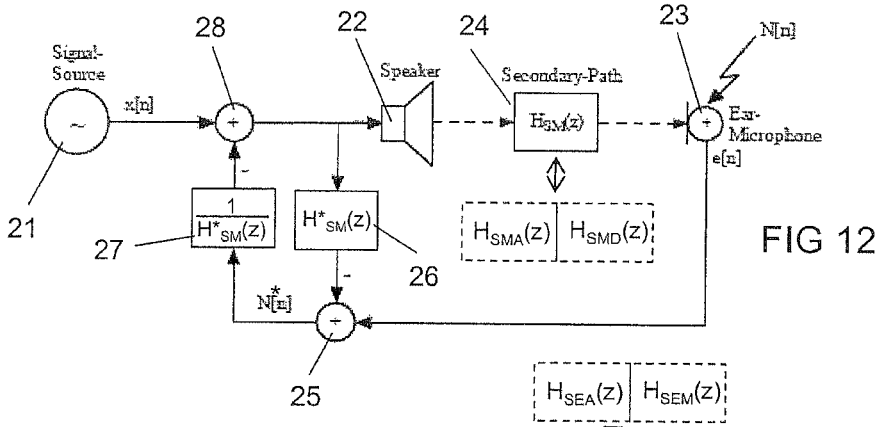
FIG. 12 is a block diagram illustration of an active noise reduction system having a closed-loop structure.

FIG. 12 is a block diagram illustration of the signal flow in an active noise reduction system that includes a signal source 21 for providing a desired signal x[n] to be acoustically radiated by a loudspeaker 22. This loudspeaker 22 also serves as a cancelling loudspeaker, e.g., comparable to the loudspeaker 4 in the system of FIG. 1. The sound radiated by the loudspeaker 22 is transferred to an error microphone 23 such as microphone 6 of FIG. 1 via a (secondary) path 24 having the transfer characteristic $H_{SM}(z)$.

The microphone 23 receives sound from the loudspeaker 22 together with noise N[n] from one or more noise sources (not shown) and generates an electrical signal e[n] therefrom. This signal e[n] is supplied to a subtractor 25 that subtracts an output signal of a filter 26 from the signal e[n] to generate a signal N*[n] which is an electrical representation of acoustic noise N[n]. The filter 26 has a transfer characteristic $H^*_{SM}(z)$ which is an estimate of the transfer characteristic $H_{SM}(z)$ of the secondary path 24. Signal N*[n] is filtered by a filter 27 with a transfer characteristic equal to the inverse of transfer characteristic $H^*_{SM}(z)$ and then supplied to a subtractor 28 that subtracts the output signal of the filter 27 from the desired signal x[n] in order to generate a signal to be supplied to the loudspeaker 22. The filter 26 is supplied with the same electrical signal as the loudspeaker 22. In the system described above with reference to FIG. 12, a so-called closed-loop structure, is used.

The transfer characteristic $H_{SM}(z)$ is composed of a transfer characteristic $H_{SMD}(z)$ representing the sound travelling in the duct 10 and a transfer characteristic $H_{SMA}(z)$ representing the sound travelling in the free air between the duct 10 and loudspeaker 22 (or loudspeaker 16 in FIGS. 4-6). The duct 10 is tuned such that the transfer characteristic $H_{SM}(z)$, if the duct 10 is present, is close to or even the same as transfer characteristic $H_{SE}(z)$, in any event closer than it would be if the duct 10 was not present. In the examples of FIGS. 12-17, the duct 10 is present even if not specified in detail, and accordingly $H_{SM}(z)=H_{SMD}(z)+H_{SMA}(z)$.

Figure 13:
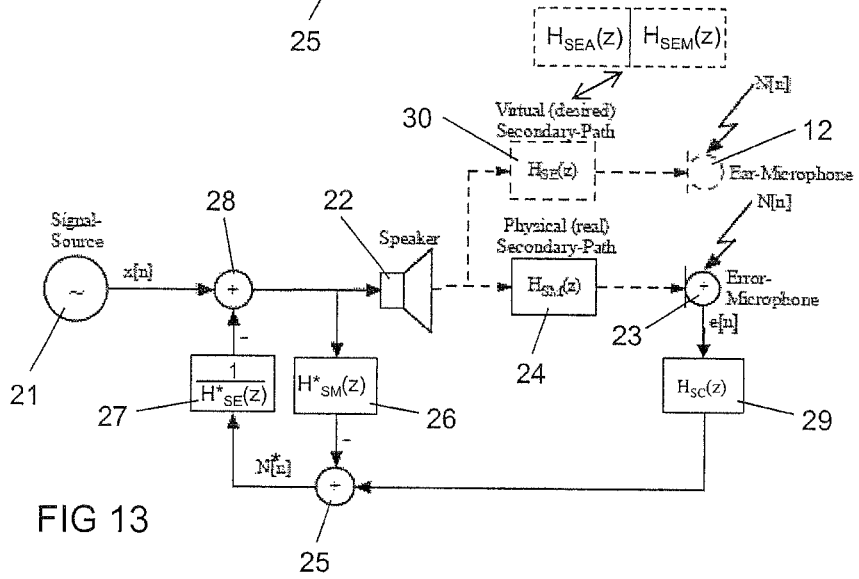
FIG. 13 is a block diagram illustration of an alternative embodiment closed loop active noise reduction system.

Referring to FIG. 13 the signal flow in another closed-loop active noise reduction system is illustrated. In this system, an additional filter 29 (e.g., digital) having a transfer characteristic $H_{SC}(z)$ is connected between the error microphone 23 and the subtractor 25. Its transfer characteristic $H_{SC}(z)$ is:

$$H_{SC}(z)=H_{SE}(z)-H_{SM}(z).$$

Accordingly, the transfer characteristics $H_{SM}(z)$ and $H_{SC}(z)$ of the actual (physical, real) secondary path 24 and the filter 29 together model the transfer characteristic $H_{SE}(z)$ of a virtual (desired) signal path 30 between the loudspeaker 22 and a microphone at a desired signal position (in the following also referred to as "virtual microphone"), e.g., the listener's ear 12. The transfer characteristic $H_{SE}(z)$ of the virtual (desired) signal path 30 may be composed of a transfer characteristic $H_{SEM}(z)$ representing the external auditory meatus (external auditory meatus 60 as illustrated with reference to FIGS. 4-6) and the transfer characteristic $H_{SEA}(z)$ of the path between the external auditory meatus and the loudspeaker 22 (loudspeaker 16 as illustrated with reference to FIGS. 4-6).

Figure 14:
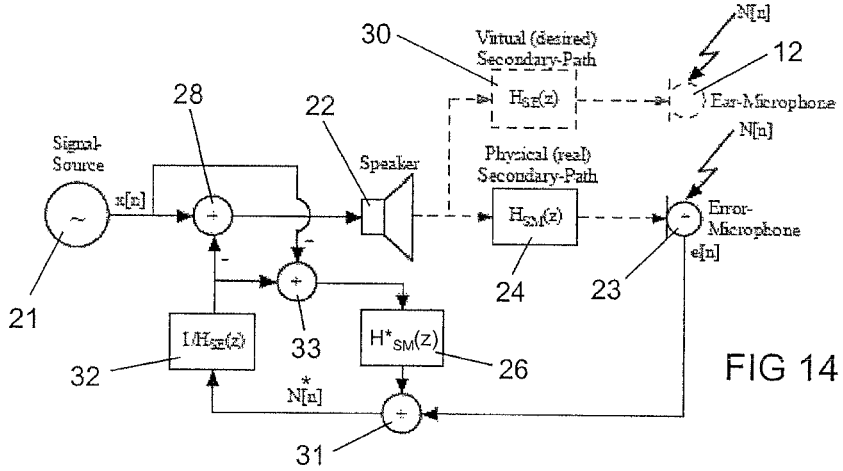
FIG. 14 is a block diagram illustration of another alternative embodiment of the active noise reduction system illustrated in FIG. 13.

When applying the above to, e.g., the systems of FIG. 4-6, the microphone 18 can be virtually shifted from its real position between the noise source 3 and the loudspeaker 16 to the (desired) position at the listener's ear 12 (depicted as ear microphone 12 in FIGS. 13 and 14). In the systems of FIGS. 4-6, the desired signal path extends from the loudspeaker 16 to a "virtual microphone", i.e., a microphone that has a virtual acoustic position differing from its real position, or with other words, "virtual microphone" means that the microphone is actually arranged at one location but appears to be at another "virtual" position by of appropriate signal filtering.

The physical (real) signal path extends from the microphone 18 (through the duct 10 if provided as the case may be) to the loudspeaker 16 as opposed to the systems of FIGS. 4-6. In the system of FIG. 13, the position of the real microphone 23 (microphone 18 in FIGS. 4-6) is virtually shifted to the desired position by the filter 29 connected downstream of microphone 23. The ideal virtual position of the microphone is the position of the listener's ear 12, in particular its tympanic membrane. When using a duct 10, its transfer characteristic will add to the transfer characteristic of the filter 29 or, with other words, achieving a certain transfer function is not solely the task of the filter 29 but also of the duct 10. Thus, electrically operating the filter 29 can be realized with less cost when used in connection with the duct 10 that forms an acoustically operating filter.

FIG. 14 illustrates the signal flow in an alternative embodiment of a closed-loop active noise reduction system. Again, the signal source 21 supplies the desired signal x[n] to the loudspeaker 22 that serves not only to acoustically radiate the signal x[n] but also to actively reduce noise. Sound radiated by the loudspeaker 22 propagates to the error microphone 23 via the (secondary) path 24 having the transfer characteristic $H_{SM}(z)$.

The microphone 23 receives the sound from the loudspeaker 22 together with noise N[n] and generates the electrical signal e[n] therefrom. Signal e[n] is supplied to an adder 31 that adds the output signal of the filter 26 to the signal e[n] to generate the signal N*[n] which is an electrical representation (in the present example an estimation) of noise N[n]. The filter 26 has the transfer characteristic $H^*_{SM}(z)$ that corresponds to the transfer characteristic $H_{SM}(z)$ of the secondary path 24. Signal N*[n] is filtered by filter 32 with a transfer characteristic equal to the inverse of transfer characteristic $H_{SE}(z)$ and then supplied to a subtractor 28 that subtracts the output signal of the filter 32 from the desired signal x[n] to generate a signal to be supplied to the loudspeaker 22. The filter 26 is supplied with an output signal of a subtractor 33 that subtracts signal x[n] from the output signal of the filter 32.

Figure 15:
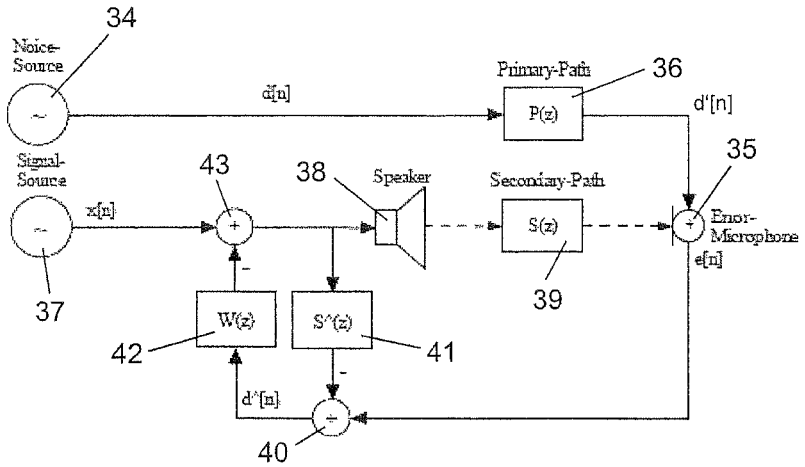
FIG. 15 is a schematic diagram of the basic principal underlying the system illustrated in FIG. 14.

In the system shown in FIG. 15, a noise source 34 propagates a noise signal d[n] that is received by an error microphone 35 via a primary (transmission) path 36 with a transfer characteristic of P(z) yielding a noise signal d'[n] at the position of the error microphone 35.

The error signal e[n] is supplied to a subtractor 40 that subtracts the output signal of a filter 41 from the signal e[n] to generate a signal d'[n] which is an estimated representation of the noise signal d'[n]. The filter 41 has the transfer characteristic Ŝ(z) which is an estimation of the transfer characteristic S(z) of the secondary path 39. Signal d̂[n] is filtered by a filter 42 with a transfer characteristic of W(z) and then supplied to a subtractor 43 that subtracts the output signal of the filter 42 from the desired signal x[n], such as, e.g., music or speech, originating from signal source 37, generating a signal to be supplied to the speaker 38 for transmission to the error microphone 35 via a secondary (transmission) path 39 having a transfer characteristic of S(z). The filter 41 is supplied with an output signal from the subtractor 43 that subtracts the output signal of filter 42 from the desired signal x[n].

The system of FIG. 15 employs an adaptation structure as described below with reference to FIG. 16. In this system, the filter 42 is a controllable filter being controlled by an adaptation control unit 44. The adaptation control unit 44 receives from the subtractor 40 the signal d̂[n] filtered by a filter 45 and from the error microphone 35 the error signal e[n] filtered by the filter 11. The filter 45 has the same transfer characteristic as the filter 41, namely Ŝ(z). The controllable filter 42 and the control unit 44 together form an adaptive filter which may use for adaptation, e.g., the so-called Least Mean Square (LMS) algorithm or, as in the present case, the Filtered-x Least Mean Square (FxLMS) algorithm. However, other algorithms may also be appropriate such as a Filtered-e LMS algorithm or the like.

Figure 16:
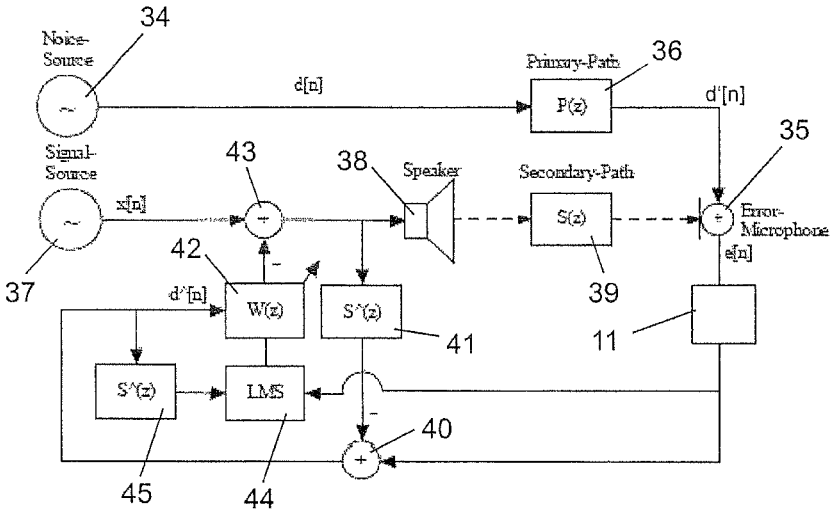
FIG. 16 is a block diagram illustration of an embodiment of an active noise reduction system disclosed herein employing a filtered-x least mean square (FxLMS) algorithm.

In general, feedback ANC systems like those shown in FIGS. 15 and 16 estimate the pure noise signal d'[n] and input this estimated noise signal d̂[n] into an active noise control (ANC) filter, i.e., the filter 42 in the present example. In order to estimate the pure noise signal d'[n], the transfer characteristic S(z) of the acoustic secondary path 39 from the speaker 38 to the error microphone 35 is estimated. The estimated transfer characteristic Ŝ(z) of the secondary path 39 is used in the filter 41 to electrically filter the signal supplied to the speaker 38. By subtracting the signal output of filter 41 from the (previously by filter 11 filtered) error signal e[n], the estimated noise signal d̂[n] is obtained. If the estimated secondary path Ŝ(z) is exactly the same as the actual secondary path S(z), the estimated noise signal d̂[n] is exactly the same as the actual pure noise signal d'[n]. The estimated noise signal d̂[n] is filtered in ANC filter 42 with the transfer characteristic W(z), wherein $$W(z)=P(z)/S(z),$$

and is then subtracted from the desired signal x[n]. Signal e[n] may be as follows:

$$\begin{aligned} e[n] &= d[n]\cdot P(z) + x[n]\cdot S(z) - \hat{d}[n]\cdot(P(z)/\hat{S}(z))\cdot S(z) \\ &= x[n]\cdot S[z] \end{aligned}$$

if, and only if Ŝ(z)=S(z) and as such d̂[n]=d'[n].

The estimated noise signal d̂[n] is as follows:

$$\begin{aligned} \hat{d}[n] &= e[n] - (x[n] - d'[n]\cdot(P(z)/\hat{S}(z))\cdot\hat{S}(z)) \\ &= d'[n]\cdot P(z) \\ &= d[n] \end{aligned}$$

if, and only if Ŝ(z)=S(z).

Accordingly, the estimated noise signal d̂[n] models the actual noise signal d[n].

Closed-loop systems such as the ones described above aim to reduce the desired signal by subtracting the estimated noise signal from the desired signal before it is supplied to the speaker. In open-loop systems, the error signal is fed through a special filter in which it is low-pass filtered (e.g., below 1 kHz) and gain-controlled to achieve a moderate loop gain for stability, and phase adapted (e.g., inverted) in order to achieve the noise reducing effect. However, it can be seen that an open-loop system may cause the desired signal to be reduced. On the other hand, open-loop systems are less complex than closed-loop systems.

Figure 17:
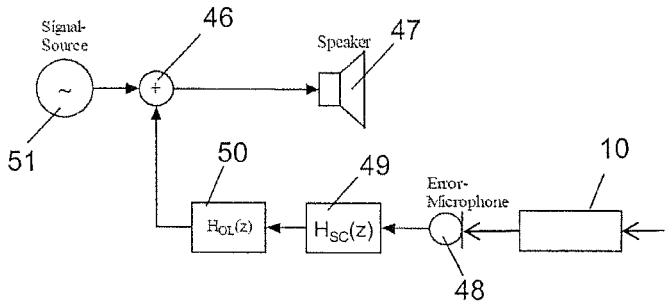
FIG. 17 is a block diagram illustration of an open loop active noise reduction system.

An exemplary open-loop ANC system is shown in FIG. 17. A signal source 51 provides a useful signal, such as a music signal, to an adder 46 whose output signal is supplied via appropriate signal processing circuitry (not shown) to a loudspeaker 47. The adder 46 also receives an error signal provided by an error microphone 48 and filtered by the filters 49 and 50 connected in series. The filter 50 has a transfer characteristic $H_{OL}(z)$ and the filter 49 with a transfer characteristic $H_{SC}(z)$. The transfer characteristic $H_{OL}(z)$ is the characteristic of a common open loop system and the transfer characteristic $H_{SC}(z)$ is the characteristic for compensating for the difference between the virtual position and the actual position of the error microphone 48.

The performance of a common closed loop ANC system increases together with the proximity of the error microphone to the ear, i.e., to the tympanic membrane. However, locating the error microphone in the ear would be extremely uncomfortable for the listener and deteriorate the quality of the perceived sound. Locating the error microphone outside the ear would worsen the quality of the ANC system. To overcome this dilemma, the systems presented herein employ acoustic filters (e.g., ducts) to allow, on the one hand, the error microphone to be located distant from the ear and, on the other hand, to provide a constantly stable performance. The error microphone may even be positioned behind the loudspeaker, i.e., between the ear-cup and the loudspeaker. Thus, the error microphone is actually positioned a bit further away from the listener's ear, which per se would inevitably lead to a worsening of ANC performance, but, nevertheless, keep ANC performance on a high level by virtually shifting the microphone into the ear of the listener.

The following systems employ digital signal processing to ensure that all signals and transfer characteristics used are in the discrete time and spectral domain (n, z). For analog processing, signals and transfer characteristics in the continuous time and spectral domain (t, s) may be used accordingly.

Referring again to FIG. 13, in order to create a virtual error microphone the ideal transfer characteristic $H_{SE}(z)$, which is the transfer characteristic on the signal path from the loudspeaker to the ear (desired secondary path), is assessed and the actual transfer characteristic $H_{SM}(z)$ on the signal path from the speaker to the error microphone (real secondary path) is determined. To determine the filter characteristic W(z) which provides at the virtual microphone position an ideal sound reception and optimum noise cancellation, the filter characteristic W(z) is set to $W(z)=1/H_{SE}(z)$. The total signal $x[n]\cdot H_{SE}(z)$ received by the virtual error microphone is:

$$N[n]+\left(\left(x[n]-\left(\frac{N[n]}{H_{SE}(z)}\right)\right)*H_{SE}(z)=x[n]*H_{SE}(z)\right.$$

The estimated noise signal N[n] that forms the input signal of the ANC system is:

$$\underbrace{\left(x[n]-\frac{N[n]}{H_{SE}(z)}\right)*H_{SM}(z)+N[n]}_{e[n]}+\left(\frac{N[n]}{H_{SE}(z)}-x[n]\right)*H_{SM}(z)=N[n]$$

According to the above equations, optimum noise suppression is achieved when the estimated noise signal N[n] at the virtual position is the same as it is in the listener's ear. The quality of the noise suppression algorithm depends mainly on the accuracy of the secondary path S(z), in the present case represented by its transfer characteristic $H_{SM}(z)$. If the secondary path changes its characteristic, the system has to adapt to the new situation, which requires additional time consuming and costly signal processing.

As one approach, the secondary path may be kept essentially stable, i.e., its transfer characteristic $H_{SM}(z)$ constant, in order to keep the complexity of additional signal processing low. For this, the error microphone is arranged in such a position that different modes of operation do not create significant fluctuations of the transfer function $H_{SM}(z)$ of the secondary path. If the error microphone is arranged within the earphone cavity, which is relatively insensitive to fluctuations but relatively far away from the ear, the overall performance of the ANC algorithm is bad. However, additional (allpass) filtering that requires only very little additional signal processing is provided to compensate for the drawbacks of the greater distance to the ear. The additional signal processing required for realizing the transfer characteristics $1/H_{SE}(z)$ and $H_{SM}(z)$ can be provided not only by digital but by analog circuitry, as well as by programmable RC filters using operational amplifiers.

Another approach is to substitute electrical signal filtering at least partly by acoustic signal filtering, e.g., by error microphones with ducts per se or in connection with resonators, damping material etc. as set forth above in connection with FIGS. 7-11. For instance, a sound-guiding tube-like duct has an almost constant transfer characteristic that increases the stability of the system against fluctuations as the secondary path transfer characteristic is at least partially formed by the duct and as such constant. An acoustic filter is relatively simple to realize, cost efficient and provides even more freedom to position the microphone without significantly increasing electrical signal processing.

Although various examples of realizing the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Such modifications to the inventive concept are intended to be covered by the appended claims.

What is claimed is:

1. An active noise reduction system comprising:

an earphone to be acoustically coupled to a listener's ear which is exposed to ambient noise, the earphone comprises a housing with an aperture;

a transmitting transducer which converts electrical signals into acoustical signals to be radiated to the listener's ear and which is arranged at the aperture of the housing thereby defining an earphone cavity located behind the transmitting transducer; and a receiving transducer which converts acoustical signals into electrical signals and provides a receiving-transducer signal indicative thereof, and which is arranged behind, alongside or in front of the transmitting transducer;

a sound-guiding conduit having a first longitudinal end and a second longitudinal end, where the first longitudinal end is acoustically coupled to the receiving transducer and the second longitudinal end is located behind, alongside or in front of the transmitting transducer;

a first acoustical path which extends from the transmitting transducer to the ear and which has a first transfer characteristic;

a second acoustical path which extends from the transmitting transducer through the sound-guiding conduit to the receiving transducer and which has a second transfer characteristic; and a control unit electrically connected to the receiving transducer and the transmitting transducer and which compensates for the ambient noise at the ear by generating a noise reducing electrical signal supplied to the transmitting transducer, where the noise reducing electrical signal is derived from the receiving-transducer signal filtered with a third transfer characteristic, and where the second and third transfer characteristics together model the first transfer characteristic.

2. The system of claim 1 in which an electrical filter with a constant fourth transfer characteristic is connected downstream of the microphone, in which the second, third and fourth transfer characteristics together model the first transfer characteristic.

3. The system of claim 1 wherein the sound-guiding conduit tube like comprises at least one Helmholtz resonator having an opening.

4. The system of claim 3 in which the openings are covered with a membrane.

5. The system of claim 1 wherein the sound-guiding conduit comprises at least one opening in its side walls.

6. The system of claim 1 wherein the sound-guiding conduit comprises at least one cross-section reducing taper.

7. The system of claim 1 wherein the sound-guiding conduit contains sound absorbing material.

8. The system of claim 1 wherein the sound-guiding conduit is bent along its longitudinal axis.

9. The system of claim 1 wherein the noise reducing electrical signal has the same amplitude over time but opposite phase compared to the ambient noise.

10. The system of claim 9 further comprising a signal source providing an electrical desired signal that is acoustically reproduced by the transmitting transducer.

11. The system of claim 10 in which the control unit further comprises:

a first filter which has a fourth transfer characteristic being the inverse of the first transfer characteristic and which provides a first filtered signal; and a second filter which has a fifth transfer characteristic being equal to the second and third transfer characteristic and that provides a second filtered signal.

12. The system of claim 11 in which at least one of the first and second filters is an adaptive filter.

13. The system of claim 11 in which the control unit further comprises:

a first subtracting unit which is connected to the first filter and the signal source and which subtracts the first filtered signal from the desired signal to generate an output signal, where the output signal is supplied to the transmitting transducer and the second filter; and a second subtracting unit which is connected to the second filter and the receiving transducer and which subtracts the second filtered signal from the output signal of the receiving transducer to generate an estimated electrical noise signal, the electrical noise signal being supplied to the first filter.

14. The system of claim 13 in which the ear has an external auditory meatus that comprises a sixth transfer function and the sound-guiding conduit is configured to have its second transfer characteristic equal to the sixth transfer characteristic.

* * * * *